US006424721B1

(12) United States Patent
Hohn

(10) Patent No.: US 6,424,721 B1
(45) Date of Patent: Jul. 23, 2002

(54) HEARING AID WITH A DIRECTIONAL MICROPHONE SYSTEM AS WELL AS METHOD FOR THE OPERATION THEREOF

(75) Inventor: Werner Hohn, Uttenreuth (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 0 days.

(21) Appl. No.: 09/262,327

(22) Filed: Mar. 4, 1999

(30) Foreign Application Priority Data

Mar. 9, 1998 (DE) ..... 198 10 043

(51) Int. Cl.[7] ..... H04R 25/00

(52) U.S. Cl. ..... 381/313; 381/356; 381/328

(58) Field of Search ..... 381/312, 313, 381/322, 324, 328, 330, 23.1, 356, 367, 380, 381, FOR 128, FOR 133, FOR 134, FOR 142, 92, 91, 122; 181/128, 129, 134, 135

(56) References Cited

U.S. PATENT DOCUMENTS

| | | | | | |
|---|---|---|---|---|---|
| 4,536,887 | A | * | 8/1985 | Kaneda et al. | 381/92 |
| 4,712,244 | A | * | 12/1987 | Zwicker et al. | 381/313 |
| 4,751,738 | A | | 6/1988 | Widrow et al. | 281/313 |
| 4,773,095 | A | | 9/1988 | Zwicker et al. | 381/327 |
| 5,033,090 | A | | 7/1991 | Weinrich | 381/328 |
| 5,737,430 | A | * | 4/1998 | Wildrow | 381/313 |
| 5,757,933 | A | * | 5/1998 | Preves et al. | 381/313 |
| 5,793,875 | A | * | 8/1998 | Lehr et al. | 381/92 |
| 5,878,147 | A | * | 3/1999 | Killion et al. | 381/328 |
| 5,949,889 | A | * | 9/1999 | Cooper | 381/328 |
| 6,075,869 | A | * | 6/2000 | Killion et al. | 381/313 |
| 6,101,258 | A | * | 8/2000 | Killion et al. | 381/92 |
| 6,327,370 | B1 | * | 12/2001 | Killion et al. | 381/313 |

FOREIGN PATENT DOCUMENTS

| | | |
|---|---|---|
| DE | 40 26 420 | 2/1991 |
| EP | 0 499 699 | 8/1992 |
| EP | 0 848 573 | 6/1998 |
| WO | WO 97/40645 | 10/1997 |

* cited by examiner

*Primary Examiner*—Xu Mei
(74) *Attorney, Agent, or Firm*—Schiff Hardin & Waite

(57) ABSTRACT

In a hearing aid with a directional microphone system having a signal processing unit, an earphone and a number of microphones, the output signals of the respective microphones can be interconnected with one another with different weightings for generating an individual directional microphones characteristic by using one or more delay elements and the signal processing unit. The invention is also directed to a method for the operation of such a hearing aid.

26 Claims, 3 Drawing Sheets

HEARING AID WITH A DIRECTIONAL MICROPHONE SYSTEM AS WELL AS METHOD FOR THE OPERATION THEREOF

BACKGROUND OF THE INVENTION

1. Field of the Invention

The present invention is directed to a hearing aid of the type having a directional microphone system, an earphone and a number of microphones. The invention is also directed to a method for the operation of a hearing aid having a directional microphone system, the hearing aid containing a signal processing unit, an earphone and a number of microphones.

2. Description of the Prior Art

Hearing aids having a directional microphone system composed of a non-directional microphone and a directional microphone directed toward the front are known, and allow the user to switch between the individual microphones by pressing a button (European Application 0 499 699). When the directional microphone directed toward the front is activated, speech comprehension improves given unwanted sound coming mainly from the side and from the back and given useful sound (i.e., audio signals which the user desires to hear) directly incident from the front. Given activation of the non-directional microphone, a good and natural speech comprehension is achieved given useful signals incident from all sides.

U.S. Pat. No. 4,751,738 discloses a hearing aid with a directional microphone system having a signal processing unit, an earphone and a number of microphones. Spaced microphones are employed whose output signals can be interconnected with one another with different weightings on the basis of different filter curves, for producing an individual directional microphone characteristic, particularly by processing in the signal processing unit (amplifier stage, summing stage and filter stage).

In some auditory situations, for example given useful sound incident from the side and from behind, such hearing aids having a non-directional microphone and a directional microphone directed toward the front allow only limited speech comprehension.

SUMMARY OF THE INVENTION

An object of the present invention is to provide a hearing aid as well as a method for the operation of a hearing aid of the type initially described wherein improved speech comprehension is achieved for an optimally large number of auditory situations, including even auditory situations that rarely occur.

The above object is achieved in an inventive hearing aid having a number of microphones—non-directional or directional microphones, the respective output signals of which being interconnectable with one another with different weightings and with different delays, resulting in a directional microphone characteristic adapted to the individual auditory situation. By appropriate weighting and delay of the microphone output signals, useful signals incident, for example, from the side and from behind can thereby be appropriately acquired, for example during a mountain hike next to a babbling brook.

The interconnection of the microphones can ensue in pairs (directional characteristic of the first order) or can incorporate three or more microphones (directional characteristic of a higher order).

Overall, the directional microphone system of the inventive hearing aid is composed of a number of individual microphones having different principal directions. Either individual directional microphones or a combination of two non-directional microphones can be employed as microphones in conjunction with an electronic signal processing circuit for weighting and different delay of the respective output signals of the non-directional microphones.

Due to a multiple utilization of non-directional microphones, the number of sound admission openings required in the hearing aid housing can be reduced, so that, for example, the front, back, left, right, top and bottom directions can be "covered" with four non-directional microphones and respective additional electronic circuits for weighting and delay of the output signals of the non-directional microphones.

When the hearing aid is fashioned as a behind-the-ear (BTE) hearing aid, the individual microphones forming the directional microphone system can be attached to the main body of the hearing aid with an appropriate alignment of the sound admission openings. For example, four microphones can be provided for picking up sound from the front, back, below and from the side.

By attaching auxiliary members to the main member of the BTE hearing aid, microphones having corresponding sound admission openings that also allow further sound incident directions, for example lateral directions, to be taken into consideration, can be attached in the auxiliary member.

Such an auxiliary member attached to the main member can be fashioned as a hinged, lever-like element. Dependent on the respective auditory situation, the user can swing the auxiliary member out on the hinge to an "active" position and thereby align the microphones contained in the auxiliary member, and given a change in the auditory situation, can again swing the auxiliary member back against the main member to a space-saving, "retracted" position.

The auxiliary member can be fashioned as a tear-shaped or arcuate lever-like element, so that it has an optical approximation of an earing. As a result, the overall optical impression of the BTE hearing aid is improved.

When the hearing aid is fashioned as an in-the-ear (ITE) hearing aid, at least three microphones can be integrated into the main member of the ITE hearing aid. Advantageous directional properties are achieved when the sound admission openings of the three microphones are arranged on connecting lines crossing one another substantially at a right angle.

An auxiliary member that is implemented as a hinged, lever-like element can also be attached to the main member of an ITE hearing aid. Further microphones can be integrated in this auxiliary member, allowing further, for example lateral, sound incidence directions to be acquired supplementing the microphones contained in the main member.

The inventive method of the operation of a hearing aid having a directional microphone system includes the step of selectively setting the principal direction of the directional microphone system in adaptation to the existing auditory situation. By employing a number of microphones, a multitude of different principal directions can be set, allowing useful sound incident from the side or from the back to be taken into consideration.

In a normal position, the principal direction "front" is preferably set in the directional microphone system, so that useful signals incident from the front, for example when two persons standing opposite one another are talking, can be acquired.

The inventive method allows the principal direction to be set over a wide range of variation, so that a complete auditory situation occurring, for example, on a mountain hike can be received and heard with the useful signals incident from the side and from behind.

In the inventive method, it is preferably first determined from which direction the strongest useful signals are incident in order to align the principal direction of the directional microphone system in accord therewith. The maximum of the sound energy or of the acoustic pressure can be employed as a criterion for determining the principal direction.

Switching from a previously set principal signal direction can ensue dependent on various criteria. The respective criteria can be stored as thresholds in the hearing aid, so that a change of the principal signal direction ensues when one or more such thresholds is/are exceeded. The principal direction of the directional microphone system can be set as a switching criterion dependent on the modulation frequency of the output signals of the individual microphones (dependent on brief-duration fluctuations of the frequencies of the reception signals).

The modulation boost (level difference between briefly loud and soft reception signals) or the absolute frequency spectrum of the output signals of the individual microphones can be employed as further switching criteria.

The difference of the frequency spectra of the signals picked up from various directions can be employed as a further switching criterion. When this difference deviates from a stored reference value, switching of the principal direction of the directional microphone system can ensue.

Further switching criteria are the absolute levels of the output signals of the individual microphones as well as the level difference of a brief-duration peak level value from the average of the level of the output signals of the microphones.

When switching the principal direction, the frequency of the upward transgression of defined level differences of signals from different directions of the output signals of the individual microphones also can be taken into consideration. As a result, an excessively frequent switching of the principal signal direction of the directional microphone system, which could result in a disquieting sound impression for the user, can be avoided.

The individual switching criteria can be continuously acquired and effect a continuous, current adaptation of the principle signal direction. Alternatively, an automatic restoration of (default to) the principal direction of "front" can ensue if no new switching direction pulses are registered after a defined time.

In order to avoid a signal distortion in the combining of the output signals, for example of the non-directional microphones, the output signals thereof are boosted before being combined with the output signals of other microphones, particularly in the range of low frequencies. In general, frequency response fading which may occur in the output signals of the respective microphones can be compensated by an equalizer.

If the hearing loss is different in the two ears of the hearing aid user, the frequency responses of the individual microphones are individually adapted to the respective hearing losses for the different directions, so that the user can already identify the main sound incidence direction with one ear.

In a further version of the method, different main signal directions are set in two microphone systems in a biaural system for the left ear and the right ear of the user, respectively, in order, for example, to be hear toward the front with one hearing aid and toward the side and toward the back with the other hearing aid. For example, this can be advantageous when traveling by automobile.

A single-channel or multi-channel AGC (automatic gain control) in the hearing aid can be differently adapted for the different level ranges in the respective response and decay times.

In further versions of the method, further, an angle between a straight line through two microphones of the hearing aid and the horizontal or vertical caused by the shape of the user's ear can be compensated. It is thus simulated that the respective microphones involved in the compensation seem to be located directly in the horizontal direction or vertical direction, despite their actual skewed position.

In order to implement a switching of the principle signal direction of the directional microphone system in an especially pleasant way and in order to avoid abrupt switching noises, the use of fuzzy electronics can be advantageous.

DESCRIPTION OF THE PREFERRED EMBODIMENTS

Figure 1:
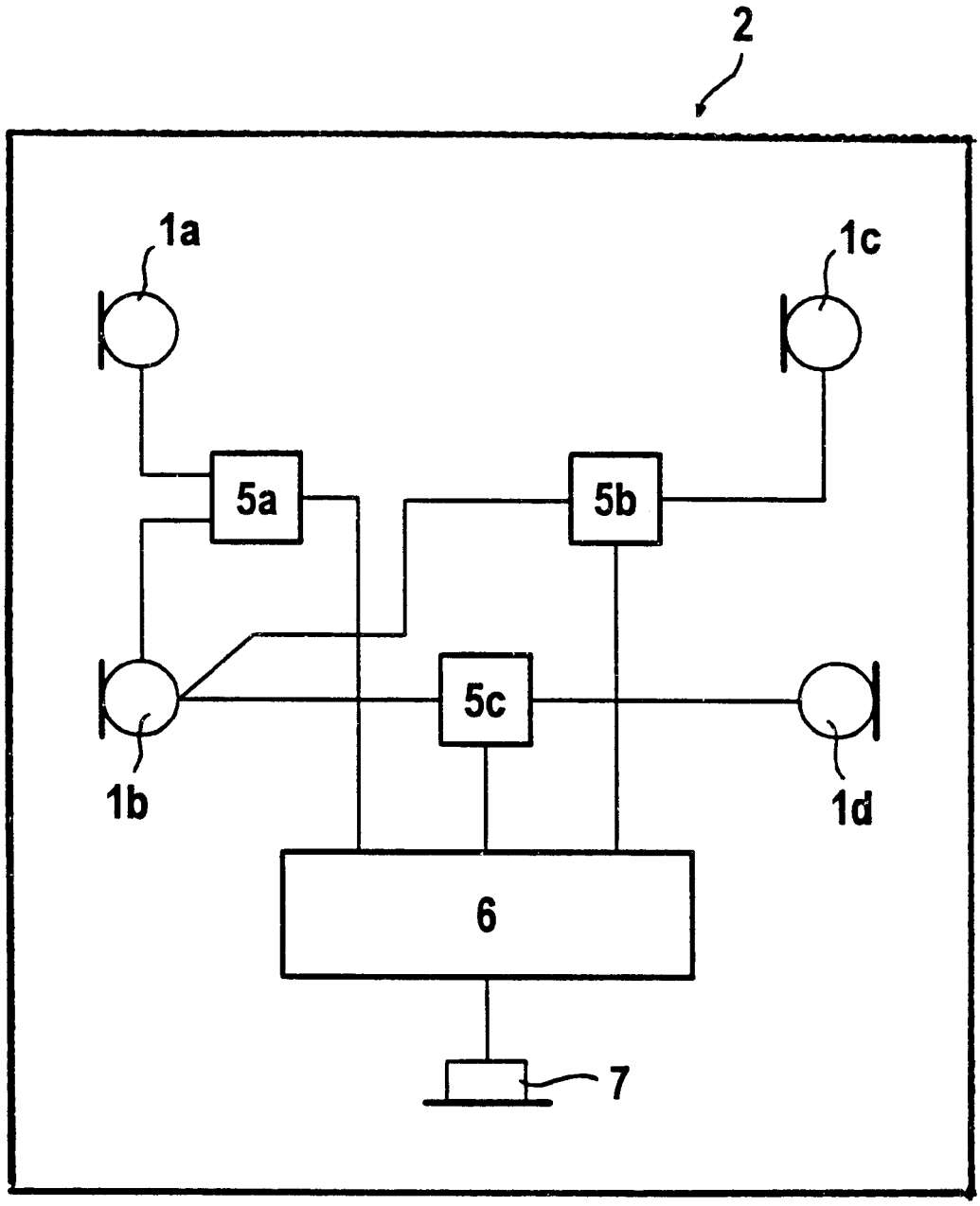
FIG. 1 is a schematic block diagram of a hearing aid having four non-directional microphones in accordance with the invention.

FIG. 1 shows a hearing aid 2 having four non-directional microphones 1*a,* 1*b,* 1*c* and 1*d* that are respectively connected in pairs via delay elements 5*a,* 5*b* and 5*c* that are known in terms of their structure and that can be set in terms of their directional effect.

Microphone 1*a* points upwardly, microphone 1*b* points toward the front microphone 1*c* points toward the right and microphone 1*d* points downwardly (relative to a person wearing the hearing aid 2). Signals from above can be reduced via the delay element 5*a,* signals from the left can be reduced via the delay element 5*b* and signals from behind can be reduced via the delay element 5C. The microphones can be interconnected in pairs 1*a* and 1*b,* 1*b* and 1*c* as well as 1*b* and 1*d* and the pairs are respectively interconnected via the delay elements 5*a,* 5*b,* 5*c* to form equivalent of a directional microphone with a set directional characteristic.

In order to achieve a directional characteristic of a higher order, three or more microphones can also be joined and interconnected (not shown).

The overall output signal is generated in a signal processing unit 6, which is connected to the delay elements 5*a,* 5*b,* 5*c,* and this output signal is supplied to the earphone 7.

Figure 2:
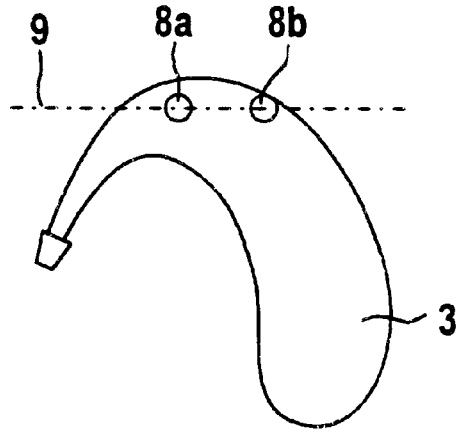
FIG. 2 is an external side view of a conventional BTE hearing aid.

FIG. 2 shows a conventional BTE hearing aid with sound emission openings 8*a,* 8*b* for a directional microphone in the main body 3. Where the hearing aid is attached to the ear, the sound emission openings 8*a,* 8*b* are ideally located on a horizontal 9.

Figure 3:
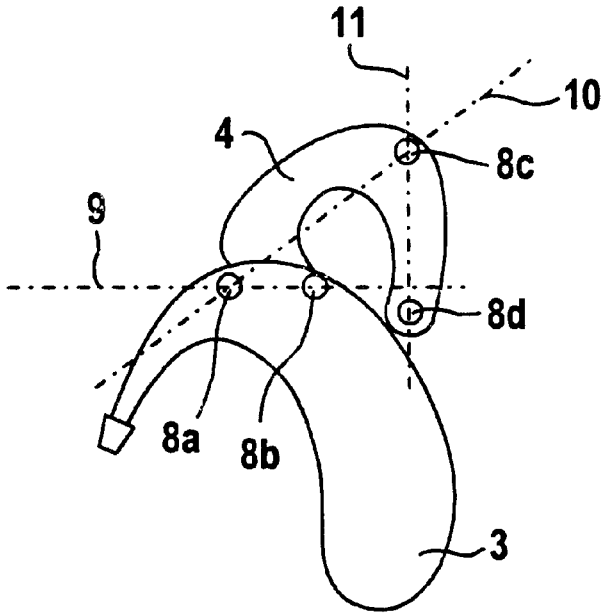
FIG. 3 is an external side view of a BTE hearing aid constructed in accordance with the invention, having a hinged, lever-like element.

An inventive BTE hearing aid is shown in FIG. 3 and has a main body 3 with the two sound admission openings 8*a,* 8*b* that lie on the horizontal 9. A hinged, lever element 4 is also provided that has further sound admission openings 8*c,* 8*d* that ideally lie on a vertical 11 when the main body 3 is attached to the ear.

For hearing toward the side, the sound admission openings 8*a,* 8*c*—as shown—should like on a transverse line 10, the transverse line 10 proceeding at a right angle relative to the horizontal 9 and relative to the vertical 11.

The sound admission openings can be provided for respective, individual non-directional microphones, or can be provided in pairs for directional microphones.

In the BTE hearing aid according to FIG. 3, thus, a respective directional microphones can be attached behind the sound admission openings 8*a,* 8*b,* or 8*c,* 8*d,* or a non-directional microphone can be attached behind each individual sound admission opening 8*a,* 8*b,* 8*c,* 8*d.*

As a result of the inventive method, the microphones attached at the main body 3 and at the lever 4 can be interconnected such that the principle signal direction of the directional microphone system formed by the combination of the microphones can be set as desired, and can be directly adapted to the current auditory situation.

Figure 4:
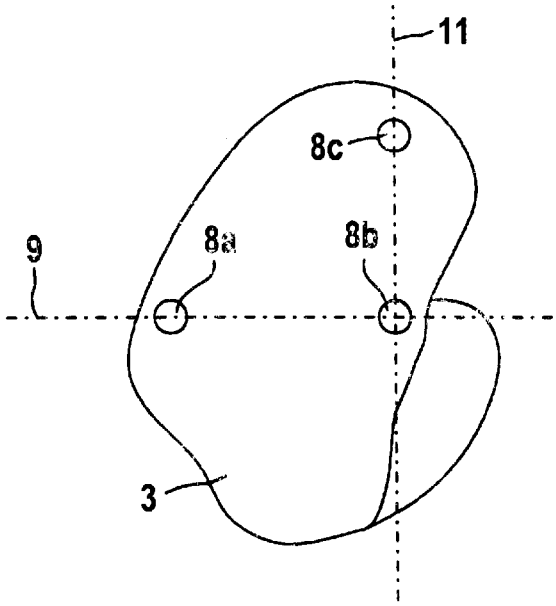
FIG. 4 is an external side view of a conventional ITE hearing aid.

FIG. 4 shows an ITE hearing aid having a main body 3, wherein the sound admission openings 8*a,* 8*b* lie on the horizontal 9 and the sound admission openings 8*b,* 8*c* lie on the vertical 11.

Figure 5:
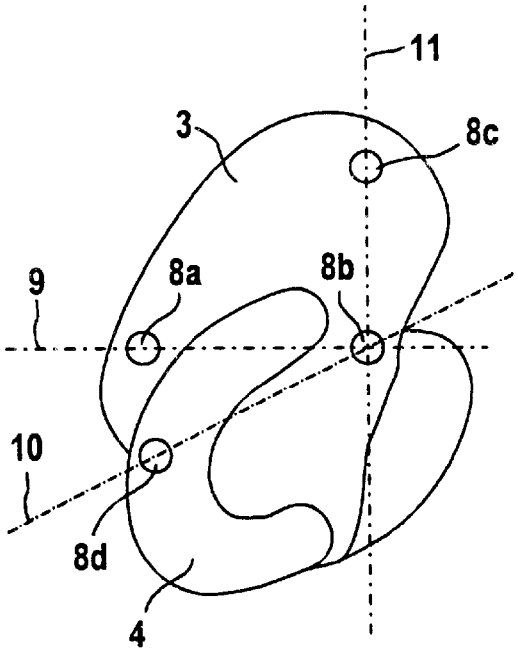
FIG. 5 is an external side view of an ITE hearing aid constructed in accordance with the invention, having a hinged, lever-like element.

FIG. 5 shows an ITE hearing aid having a main member 3 with the sound admission openings 8*a,* 8*b,* 8*c* and having a lever 4 having a sound admission opening 8*d.* Ideally, the sound admission openings 8*a,* 8*b* lie on a horizontal 9, the sound admission openings 8*b,* 8*c* lie on a vertical 11 and the sound admission opening 8*d* lies on the transverse line 10. The horizontal 9, the transverse line 10 and the vertical 11 reside at right angles relative to one another (i.e., they are orthogonal).

A principle signal direction in the lateral direction can also be realized via the microphone, particularly non-directional microphone integrated in the lever 4 behind the sound admission opening when the lever 4 is swung on the hinge away from the main body 3, so that the connecting line of the sound admission openings 8*b,* 8*d* intersects at a right angle with the connecting lines of the sound admission openings 8*a,* 8*b* as well as 8*b,* 8*c.*

When the principle signal direction toward the side is no longer required, the lever 4 can again be swung against the main body 3 in an optically favorable way. The hinge mechanism employed for this purpose is not shown.

When the connecting lines of the sound admission openings of the hearing aids of FIGS. 3 and 5 do not, due to the anatomy of the ear of the user, lie on the horizontal 9, transverse lines 10 or verticals 11 as shown, the inventive method enables a compensation of the deviation from the horizontal 9, the transverse line 10 or the vertical 11 by mixing and weighting the output signals of the microphones arranged behind the respective sound admission openings.

The simulation of a hearing aid arranged ideally in view of the course of the connecting lines of the sound admission openings relative to the horizontal 9, the transverse line 10 and the vertical 11, despite the anatomy in the ear of the user, can be accomplished by mixing and weighting the output signals.

Although modifications and changes may be suggested by those skilled in the art, it is the intention of the inventor to embody within the patent warranted hereon all changes and modifications as reasonably and properly come within the scope of his contribution to the art.

I claim as my invention:

1. A hearing aid comprising:

a housing adapted to be worn at an ear;

a plurality of microphones in said housing selected from the group consisting of directional microphones and non-directional microphones, each of said microphones having a principal reception direction and each of said microphones producing an electrical output signal;

a signal processing unit in said housing which produces a processed electrical signal;

an earphone in said housing supplied with said processed electrical signal which converts said processed electrical signal into an acoustic output signal;

a plurality of delay elements in said housing connected between said plurality of microphones and said signal processing unit in different selectable combinations, for combining the respective electrical output signals of said microphones with different delays and weightings to form, in combination with said signal processing unit, a directional microphone system with a system reception characteristic having a system principal reception direction;

said plurality of microphones being respectively disposed in said housing with their respective principal reception directions crossing substantially at a right angle; and said signal processing unit comprising means for setting said system principal reception direction at any direction between the respective principal reception directions of said plurality of microphones.

2. A hearing aid as claimed in claim 1 wherein said plurality of microphones include at least three non-directional microphones disposed on respective connecting lines which cross each other substantially at a right angle at an intersecting point, with one of said at least three non-directional microphones being disposed at said intersecting point.

3. A hearing aid as claimed in claim 1 wherein said plurality of microphones include at least four non-directional microphones, with three of said four non-directional microphones being disposed on respective connecting lines which cross each other substantially at a right angle at an intersecting point, with one of said three microphones being disposed at said intersecting point, and with a fourth of said at least four microphones being disposed on a line perpendicular to a plane containing said three microphones, said perpendicular line proceeding through one of said three microphones.

4. A hearing aid as claimed in claim 1 wherein said plurality of microphones include at least two directional microphones, the respective principal directions of said at least two directional microphones being disposed substantially at a right angle to each other.

5. A hearing aid as claimed in claim I wherein said plurality of said microphones includes at least three directional microphones with respective principal reception directions disposed toward a front of said housing, a bottom of said housing, and a side of said housing.

6. A hearing aid as claimed in claim 1 wherein said plurality of microphones includes at least five directional microphones having respective principal reception directions oriented toward a front of said housing, a back of said housing, a bottom of said housing, a top of said housing and a side of said housing.

7. A hearing aid as claimed in claim 1 wherein said housing comprises a main body and an auxiliary member attached to said main body, with at least one microphone in said plurality of microphones being disposed in said auxiliary body.

8. A hearing aid as claimed in claim 7 wherein said auxiliary body comprises a lever-like element projecting from said main body.

9. A hearing aid as claimed in claim 7 wherein said auxiliary member is connected to said main body by a hinge allowing said auxiliary member to swing around said hinge relative to said main body.

10. A method for operating a hearing aid comprising:

providing a housing adapted to be worn at an ear;

providing a plurality of microphones in said housing selected from the group consisting of directional microphones and non-directional microphones, each of said microphones having a principal reception direction and each of said microphones producing an electrical output signal;

providing a signal processing unit in said housing and producing a processed output signal with said signal processing unit;

providing an earphone in said housing and converting said processed electrical signal in said earphone into an output audio signal;

providing a plurality of delay elements in said housing and connecting said plurality of microphone in respective combinations with different delays and different weightings to said signal processing unit via said delay elements and thereby creating a directional microphone system with a system reception characteristic having a system principal reception direction;

disposing said plurality of microphones in said housing with their respective principal reception directions crossing substantially at a right angle; and creating said directional microphone system with said system principal direction disposed at a selected direction between the respective principal reception directions of said plurality of microphones.

11. A method as claimed in claim 10 wherein said housing has a front, and comprising the additional step of setting said system principal reception direction toward said front of said housing as a default setting for normal operation.

12. A method as claimed in claim 10 wherein the step of setting said system principal reception direction comprises setting said system principal reception direction dependent on a direction of highest acoustic pressure received by said plurality of microphones.

13. A method as claimed in claim 10 wherein the step of setting said system principal reception direction comprises setting said system principal selection direction dependent on a modulation frequency of the respective output electrical signals of said plurality of microphones.

14. A method as claimed in claim 10 wherein the step of setting said system principal reception direction comprises setting said system principal reception direction dependent on a modulation boost of the respective output electrical signals of said plurality of microphones.

15. A method as claimed in claim 10 wherein the step of setting said system principal reception direction comprises setting said system principal reception direction dependent on an absolute frequency spectrum of the respective output electrical signals of said plurality of microphones.

16. A method as claimed in claim 10 wherein the step of setting said system principal reception direction comprises setting said system principal reception direction dependent on a different in frequency spectra between respective output electrical signals from said plurality of microphones.

17. A method as claimed in claim 10 wherein the step of setting said system principal reception direction comprises setting said system principal reception direction dependent on an absolute value of the respective output electrical signals of said plurality of microphones.

18. A method as claimed in claim 10 wherein the step of setting said system principal reception direction comprises setting said system principal reception direction dependent on a level difference of a brief-duration peak level value from an average level of the respective output electrical signals of said plurality of microphones.

19. A method as claimed in claim 10 wherein the step of setting said system principal reception direction comprises setting said system principal reception direction dependent on a number of times that the respective output electrical signals of said plurality of microphones exceed a predetermined signal level difference between respective output electrical signals of said plurality of microphones.

20. A method as claimed in claim 10 wherein said plurality of microphones include non-direction microphones, and comprising the additional step of boosting the respective electrical output signals at least of said non-directional microphones with respect to low frequencies thereof to obtain boosted output signals, before combining the respective boosted output signals with other output electrical signals from other microphones in said plurality of microphones.

21. A method as claimed in claim 10 wherein the step of providing a plurality of microphones comprises providing a plurality of microphones having respectively different frequency responses adapted to a hearing impairment of a user of said hearing aid.

22. A method as claimed in claim 10 wherein the step of providing a housing comprises providing a first housing, and comprising the additional step of providing a second housing, said first housing being adapted to be worn at a left ear and said second housing being adapted to be worn at a right ear of a user, and distributing said plurality of microphones between said first and second housings so that said directional microphone system comprises a binaural directional microphone system.

23. A method as claimed in claim 10 wherein the step of providing a signal processing unit comprises providing a signal processing unit having automatic gain control, and comprising the additional step of adjusting said automatic gain control differently for different level ranges of said output electrical signals of said plurality of microphones.

24. A method as claimed in claim 10 wherein, due to the shape of the ear of a user, at least two of said microphones in said plurality of microphones are disposed on a straight line that deviates from a horizontal line, and comprising the additional step of compensating for said deviation from said horizontal line by adjusting at least one of said delays and weightings used to produce said directional microphone system.

25. A method as claimed in claim 10 wherein, due to the shape of the ear of a user, at least two of said microphones in said plurality of microphones are disposed on a straight line that deviates from a vertical line, and comprising the additional step of compensating for said deviation from said vertical line by adjusting at least one of said delays and weightings used to produce said directional microphone system.

26. A method as claimed in claim 10 comprising the additional step of operating said signal processing unit according to fuzzy logic.

* * * * *